US007894623B2

(12) United States Patent
Mihelich et al.

(10) Patent No.: US 7,894,623 B2
(45) Date of Patent: Feb. 22, 2011

(54) LOUDSPEAKER HAVING AN INTERLOCKING MAGNET STRUCTURE

(75) Inventors: Ryan J. Mihelich, Indianapolis, IN (US); Jason M Semmler, Greenwood, IN (US); John F. Steere, Martinsville, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 1312 days.

(21) Appl. No.: 11/386,359

(22) Filed: Mar. 22, 2006

(65) Prior Publication Data

US 2007/0223777 A1 Sep. 27, 2007

(51) Int. Cl.
*H04R 1/00* (2006.01)
*H04R 9/06* (2006.01)
*H04R 11/02* (2006.01)

(52) U.S. Cl. ..... 381/412; 381/414; 381/420; 381/421

(58) Field of Classification Search ..... 381/396, 381/400, 412, 414, 420, 421; 335/231
See application file for complete search history.

(56) References Cited

U.S. PATENT DOCUMENTS

| | | | | |
|---|---|---|---|---|
| 3,201,529 | A | 8/1965 | Surh | 179/115.5 |
| 3,898,393 | A | 8/1975 | Digre | 179/119 |
| 4,256,930 | A | 3/1981 | Garner et al. | 179/116 |
| 4,737,992 | A | 4/1988 | Latham-Brown et al. | 381/194 |
| 4,868,882 | A | 9/1989 | Ziegenberg et al. | 381/200 |
| 4,965,839 | A | 10/1990 | Elieli | 381/195 |
| 4,979,220 | A | 12/1990 | Chen | 381/192 |
| 5,040,221 | A | 8/1991 | Edwards et al. | 381/194 |
| 5,214,710 | A | 5/1993 | Ziegenberg et al. | 381/199 |
| 5,548,657 | A | 8/1996 | Fincham | 381/182 |
| 5,590,210 | A | 12/1996 | Matsuo et al. | 381/199 |
| 5,594,805 | A | 1/1997 | Sakamoto et al. | 381/199 |
| 5,625,701 | A | 4/1997 | Scanlan | 381/197 |
| 5,701,357 | A | 12/1997 | Matsuo et al. | 381/199 |
| 5,898,786 | A * | 4/1999 | Geisenberger | 381/420 |
| 6,243,479 | B1 | 6/2001 | Proni | 381/420 |
| 6,842,529 | B2 | 1/2005 | Koura et al. | 381/397 |
| 7,016,514 | B2 | 3/2006 | White et al. | 381/397 |

(Continued)

FOREIGN PATENT DOCUMENTS

| | | |
|---|---|---|
| DE | 19604088 | 8/1997 |

(Continued)

*Primary Examiner*—Brian Ensey
(74) *Attorney, Agent, or Firm*—Brinks Hofer Gilson & Lione

(57) ABSTRACT

A magnet structure for use with a loudspeaker has an interlocking mechanism. The magnet structure can include a magnet, a shell pot and at least one core cap. The shell pot can contain the magnet in its hollow interior. The magnet can be a single magnet or double magnets. The core cap has two surfaces. For a single magnet, one surface of the core cap faces the magnet. For double magnets, the core cap can be vertically disposed between the two magnets. The magnet, the core cap and the shell pot can interlock with one another such that a position of the magnet relative to the core cap and the shell pot can be rigidly preserved. The magnet can be configured to be, for example, overlapped, inserted, staked and/or engaged with at least one of the shell pot or the core cap.

32 Claims, 10 Drawing Sheets

U.S. PATENT DOCUMENTS

| | | | | |
|---|---|---|---|---|
| 7,120,270 | B2 | 10/2006 | Aronson et al. | 381/397 |
| 7,149,323 | B2 | 12/2006 | Yamagishi | 381/415 |
| 7,184,567 | B2 | 2/2007 | Sugata et al. | 381/433 |
| 2004/0120543 | A1 | 6/2004 | Sun | 381/424 |
| 2004/0197007 | A1* | 10/2004 | Onuma | 381/400 |
| 2006/0093180 | A1 | 5/2006 | Kim | 381/412 |
| 2006/0215871 | A1 | 9/2006 | Funahashi et al. | 381/396 |
| 2007/0036382 | A1 | 2/2007 | Gladwin et al. | 381/338 |

FOREIGN PATENT DOCUMENTS

| | | | |
|---|---|---|---|
| DE | 198 08 688 | A1 | 9/1998 |
| EP | 0 581 129 | A1 | 7/1993 |
| EP | 0 622 971 | B1 | 7/1998 |
| GB | 2 188 790 | A | 10/1987 |
| JP | 7059195 | | 3/1995 |
| SE | 9602701-6 | | 3/1998 |
| WO | WO 96/12382 | | 4/1996 |
| WO | WO 98/02017 | | 1/1998 |

* cited by examiner

LOUDSPEAKER HAVING AN INTERLOCKING MAGNET STRUCTURE

BACKGROUND OF THE INVENTION

1. Technical Field

This invention relates to a loudspeaker and more particularly, to a loudspeaker having an interlocking magnet structure.

2. Related Art

A transducer is a device that converts one form of an input signal to another form. Loudspeakers are one example of a transducer. Loudspeakers convert electrical signals to sound. Loudspeakers include a diaphragm, a voice coil and a magnet. The voice coil is connected to the diaphragm and disposed in an air gap. The magnet generates magnetic flux in the air gap. As input current flows through the voice coil, it creates an induced magnetic field that reacts with the magnetic flux in the air gap generated by the magnet. This causes the voice coil to oscillate, which in turn causes the diaphragm to move. As a result, sound is generated. Other structures such as a spider, a core cap, a frame, a dust cap, etc. may be used to form loudspeakers.

Loudspeakers include a magnet structure. The magnet structure may include, among other components, the magnet, the core cap and a shell pot. During manufacturing of the magnet structure, adhesives may be used to secure the position of the magnet, the core cap and the shell pot with respect to one another. The shell pot may be a housing that contains the magnet and the core cap. For example, the shell pot may have cylindrical shape with a hollow interior. The magnet may be disposed on a floor of the shell pot. The core cap is mounted on the magnet or between two magnets.

Adhesive used in the magnet structure may be affected by working environment of loudspeakers such as temperature fluctuations, including hot or cold weather, wet conditions, etc. For instance, loudspeakers used in mobile environment such as moving vehicles may experience temperature fluctuation more frequently.

SUMMARY

A magnet structure for use with a loudspeaker may have various interlocking mechanisms. The magnet structure may include a magnet, a core cap and a shell pot. The shell pot may receive the magnet and the core cap in its hollow interior. The magnet may be vertically mounted on the shell pot, and the core cap may be mounted on the magnet. The magnet may be a single magnet or may include two magnets. In the motor, the magnet may interlock with the core cap and/or the shell pot, for example, by using one or more apertures, protrusions, extensions, flanges, and/or recesses.

In one example magnet structure, the magnet may have an aperture and the shell pot may have a protrusion. The magnet having the aperture may interlock with the protrusion of the shell pot such that the magnet may be securely positioned. The core cap may have extensions that enter the aperture and engage with the magnet. Upon engagement with the magnet, the extensions may not reach the shell pot.

Alternatively, the magnet may have no aperture and be solid. In that case, the shell pot may have a recess and the magnet may engage with the recess of the shell pot. Accordingly, the magnet may be securely positioned. The core cap may be placed on one surface of the magnet. The core cap may have a body member and a flange formed at an outer edge of the body member. The flange may surround a peripheral edge of the magnet and extend toward the shell pot. The magnet may be further secured with the flange.

In another example magnet structure, a magnet having an aperture may interlock with a core cap having horizontal extensions and vertical extensions. The shell pot may or may not have a recess. Additional interlocking members such as a staking member may be used. The additional members may further secure the magnet to the core cap and the shell pot.

Additionally, the interlocking magnet structure may be equipped with a venting passageway which may be provided at a predetermined location. The venting passageway may be formed by apertures that may penetrate the magnet, the core cap and/or the shell pot. The venting passageway may operate as a passageway for heat, and/or acoustical tuning. Heat may be built up in the magnet structure as electrical current flows during operation of the loudspeaker.

A method of manufacturing a magnet structure for use with a loudspeaker may produce an aperture in a magnet. A core cap may be configured to have extensions. The extensions and the aperture may interlock with each other such that the position of the magnet may be secured without any adhesive. When the magnet structure includes two magnets, the core cap may be disposed between the two magnets. The extensions of the core cap may be inserted into each aperture of the two magnets.

Another method for manufacturing a magnet structure for use with a loudspeaker may produce no aperture in a magnet. In this method, a core cap may be configured to have a flange extending along an edge of the magnet. A shell pot may be produced to have a recess on a base surface of the shell pot. The magnet and the shell pot may interlock via the recess, and the magnet and the core cap may interlock via the flange.

In the magnet structure, adhesives may not be used. The interlocking mechanism may provide stable mechanical connections in the magnet structure. Sophisticated and labor-intensive manufacturing process may not be needed. The manufacturing process may be relatively simple and easy and expenses may be minimized. Furthermore, venting advantages may be achieved along with the adhesive-free interlocking mechanism.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
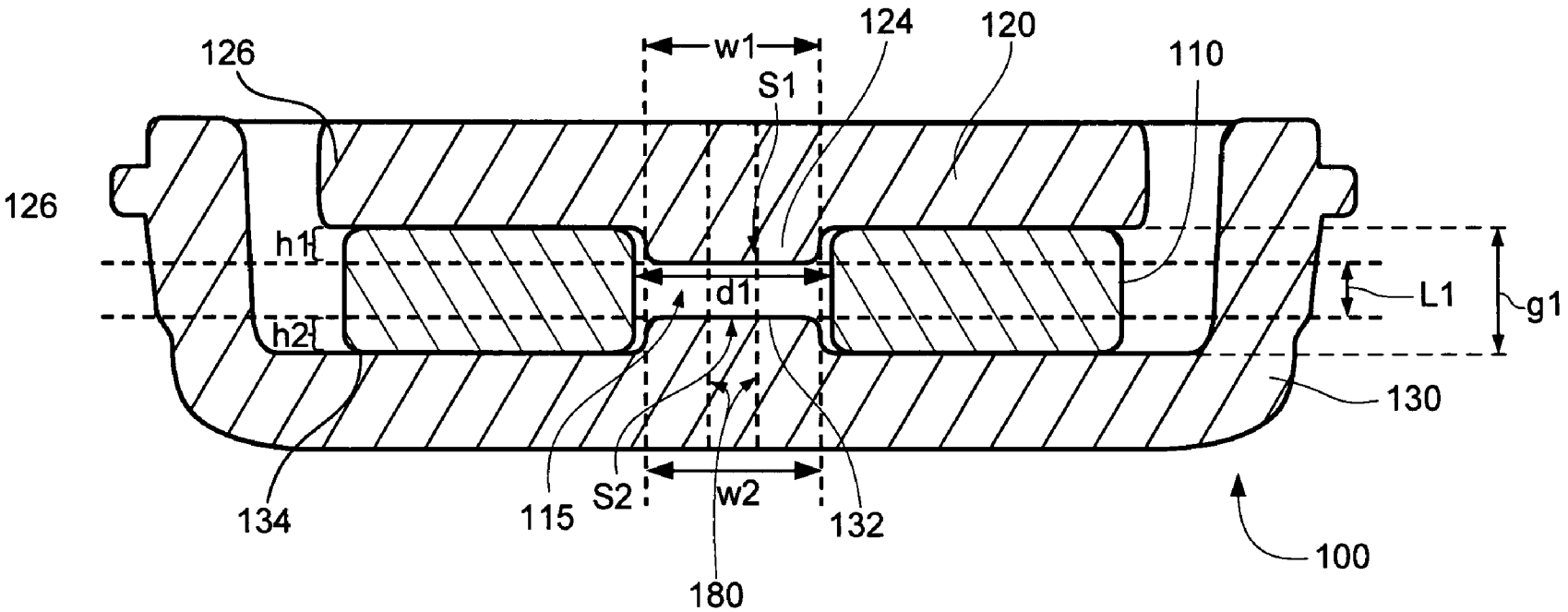
FIG. 1 illustrates a cross-sectional view of a first example of an interlocking magnet structure for a single magnet type.

FIG. 1 illustrates a first example of an interlocking magnet structure 100 for a single magnet type. The interlocking magnet structure 100 may include a magnet 110, a core cap 120 and a shell pot 130 that are configured to interlock with one another. The magnet 110 may be made from various materials such as neodymium, ceramic, etc. The core cap 120 and the shell pot 130 may be made from ferromagnetic materials, such as iron, steel, etc. but are not limited thereto. In FIG. 1, the magnet 110 has disc shape; in other examples, the magnet 110 may have other shapes such as a rectangular shape. The magnet 110 may be formed to define an aperture 115 in its center. The aperture 115 has a diameter d1 and a depth g1. Length L1 may be a distance between a surface S1 of the core cap 120 and a surface S2 of the shell pot 130. The length L1 may be provided to avoid a magnetic short circuit.

The core cap 120 may have a disc shape and be placed on the disc-shaped magnet 110, as shown in FIG. 1. The core cap 120 includes a body member 126 and a nub 124. The nub 124 may be a protrusion or lump extending a predetermined distance (h1) substantially perpendicular to the body member 126. The nub 124 may have a width w1. The width w1 may be substantially equal to or slightly smaller than the diameter d1. The nub 124 is inserted into the aperture 115 and upon the insertion, the magnet 110 may be firmly secured. To minimize friction during insertion, a side surface of the nub 124 may be tapered (see 334 in FIG. 4). The inserted nub 124 extends into the aperture 115. The extension of the nub 124 into the aperture 115 may proceed to the extent that the length L1 is obtained. A height h1 of the nub 124 may be determined in light of the length L1. For instance, a threshold value of L1 may be determined, taking into consideration the size of the magnet 110, the strength of the magnetic flux generated by the magnet 110, the size of the core cap 120, etc. The nub 124 extends to preserve the determined threshold value of length L1. Further, the interlocking structure of the shell pot 130 also may be considered, as will be described later.

Figure 2:
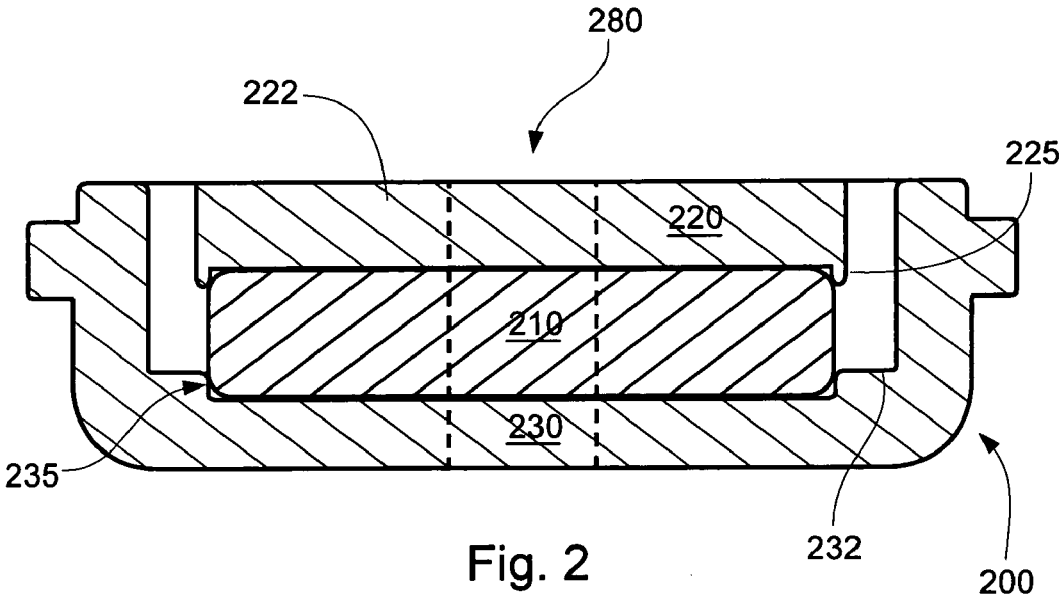
FIG. 2 illustrates a cross-sectional view of a second example of a single-magnet interlocking magnet structure with a flange.

The shell pot 130 may include a protrusion 132. The protrusion 132 extends substantially perpendicular relative to a base surface 134 of the shell pot 130. Alternatively, the shell pot 130 may have a recess on the base surface 134, as illustrated in FIG. 2. The protrusion 132 may enter the aperture 115 and engage with the magnet 110. The protrusion 132 has a width W2, which also may be substantially identical to or slightly smaller than the diameter d1. This may allow the protrusion 132 to be press fit into the aperture 115. The width W1 may be substantially identical to the width W2. Like the nub 124, a height h2 of the protrusion 132 may be determined in light of the length L1. Accordingly, the depth g1 of the magnet 110 may be equal to h1+h2+L1.

As noted above, the depth L1 may operate to prevent magnetic saturation. When the magnet 110 generates magnetic flux, the core cap 120 may provide a path for the magnetic flux to pass. The core cap 120 may be made from material that has good conductivity of the magnetic flux such as steel or iron. Surroundings of the core cap 120, i.e., air may be relatively more resistant to the magnetic flux. Air space corresponding to the 30 length L1 may provide resistance to the flow of the magnetic flux. Due to this resistance, the magnetic circuit formed at least with the magnet 110, the core cap 120 and the shell pot 130 may not be short-circuited.

The diameter d1, the length L1, the width w1, and the width w2 may vary depending on the size of the magnet 110, the thickness of the core cap 120, etc. By way of example only, dimensions for the diameter d1, the length L1, and the width w1 may be 5.00 mm, 3.20 mm, and 4.80 mm, respectively. The width w2 may be identical to the width w1, e.g., 4.80 mm. Various other dimensions are possible.

In the magnet structure 100, the protrusion 132 may secure the magnet 110 at the center of the shell pot 130 and the nub 124 may secure the core cap 120 and the magnet 110. As a result, the magnet 110, the core cap 120 and the shell pot 130 may internally interlock with one another such that they may be concentrically positioned. Alternatively, the protrusion 132, the aperture 115 and the nub 124 may interlock at an off-center position. Additionally, two or more of protrusions and nubs are possible. No external member or structure may be needed to interlock the magnet 110, the core cap 120 and the shell pot 130.

Adhesives may not be used to secure positioning of the magnet 110, the core cap 120 and the shell pot 130 in the motor 100. The interlocking mechanism with the nub 124, the aperture 115 and the protrusion 132 may permit stable positioning of the magnet 110 to the core cap 120 and the shell pot 130. Alternatively, adhesive may be used to further enhance stable positioning.

The interlocking structure among the magnet 110, the core cap 120 and the shell pot 130 may be substantially resistant to temperature fluctuations. Unlike adhesives, the interlocking structure may not be affected by temperature fluctuation. Further, the interlocking structure may not require additional manufacturing processes and/or labor-intensive processes. It may also be relatively easy and simple to manufacture the interlocking motor 100.

Additionally, in the magnet structure 100, a vent passageway 180 may be formed through the core cap 120 and the shell pot 130. Alternatively, the core cap 120 and the shell pot 130 may have no aperture or similar structure. For venting purposes, however, the passageway 180 may be formed by apertures that penetrate the core cap 120 and the shell pot 130. The passageway 180 also may include the aperture 115 of the magnet 110. During operation of the motor 100 in a loudspeaker, heat may be built up in the motor 100. The heat may be dissipated by allowing air to move through the passageway 180; otherwise, it may affect the operation of the loudspeaker, as will be described in detail in conjunction with FIG. 6. The passageway 180 may operate as a heat dissipating channel.

FIG. 2 illustrates a second example of an interlocking magnet structure 200 for a single magnet type. The interlocking magnet structure 200 includes a magnet 210, a core cap 220 and a shell pot 230. Unlike the magnet 110 of the motor 100 of FIG. 1, the magnet 210 may have no aperture. In the motor 200, interlocking may occur among the shell pot 230, the magnet 210 and the core cap 220 with a recess 235 of the shell pot 230 and a flange 225 of the core cap 220. The magnet 210 and the core cap 220 have a disc shape but are not limited thereto. The shell pot 230 includes a recess 235 concentrically disposed in the shell pot and formed to accommodate a portion of the magnet 210. The recess 235 may have a diameter that is substantially identical to a diameter of the magnet 210. The shape of the recess 235 may vary depending on the shape of the magnet 210 and/or the core cap 220. If the magnet 210 may have rectangular shape, the recess 235 may correspond to that of the magnet 210. The depth of the recess 235 may be determined to sufficiently hold the position of the magnet 110. For a relatively large magnet, the recess 235 may be relatively deep; for a relatively small magnet, the recess 235 may be relatively shallow.

In the magnet structure 200, the magnet 210 may be centrally positioned within the recess 235. The magnet 210 may be placed in the recess 235 such that it is secured by the shell pot 230. Adhesive may be added to strengthen the interlock between the magnet 210 and the recess 235. The recess 235 may have a magnet mounting zone shaped and sized to allow a bottom surface of the magnet 210 to be positioned.

The core cap 220 is contiguously mounted on the magnet 210. The core cap 220 has a body member 222 and the flange 225 extending from the body member 222. The core cap 220 has a disc shape in this example. The flange 225 may be radially formed at a circumferential edge of the body member 222 to surround a peripheral edge of the magnet 210 and extend toward the shell pot 230. Adhesives may be used to couple the core cap 220 with the magnet 210. The flange 225 may secure the positioning of the core cap 220 relative to the magnet 210. The length that the flange 225 extends from the body member 222 toward the shell pot 230 may vary depending on the size of the magnet 210 and the strength of the magnetic flux generated by the magnet 210. If the magnet 210 is large in size, the flange 225 may extend further toward the shell pot 230. On the other hand, the flange 225 may be relatively short for a smaller magnet 210. In any case, the flange 225 may not reach a base surface 232 and the recess 235 of the shell pot 120 to avoid a magnetic short circuit. Alternatively, or additionally, another flange may be added when a second magnet is added on top of the core cap 220, as will be described later in connection with FIG. 8.

The interlocking magnet structure 200 may use none or a minimized amount of adhesive to secure the connection between the magnet 210 and the core cap 220. No additional external members or structures may be required to form the interlock. The members included in the motor 200 may be configured to internally interlock with one another. Even without adhesive, the flange 225 and the recess 235 may maintain the positioning of the magnet 210. Accordingly, the magnet structure 200 may remain stable over a prolonged use. Further, manufacturing of the magnet structure 200 may not require special equipment and/or process. Production expenses may be minimized.

Additionally, in the magnet structure 200, a passageway 280 as indicated with dotted vertical lines may be provided for venting of heat as previously described. To that end, the magnet 210 may be formed to have a center aperture. The core cap 220 also may have an aperture as well as the shell pot 230. Heat may be dissipated through the passageway 280.

Figure 3:
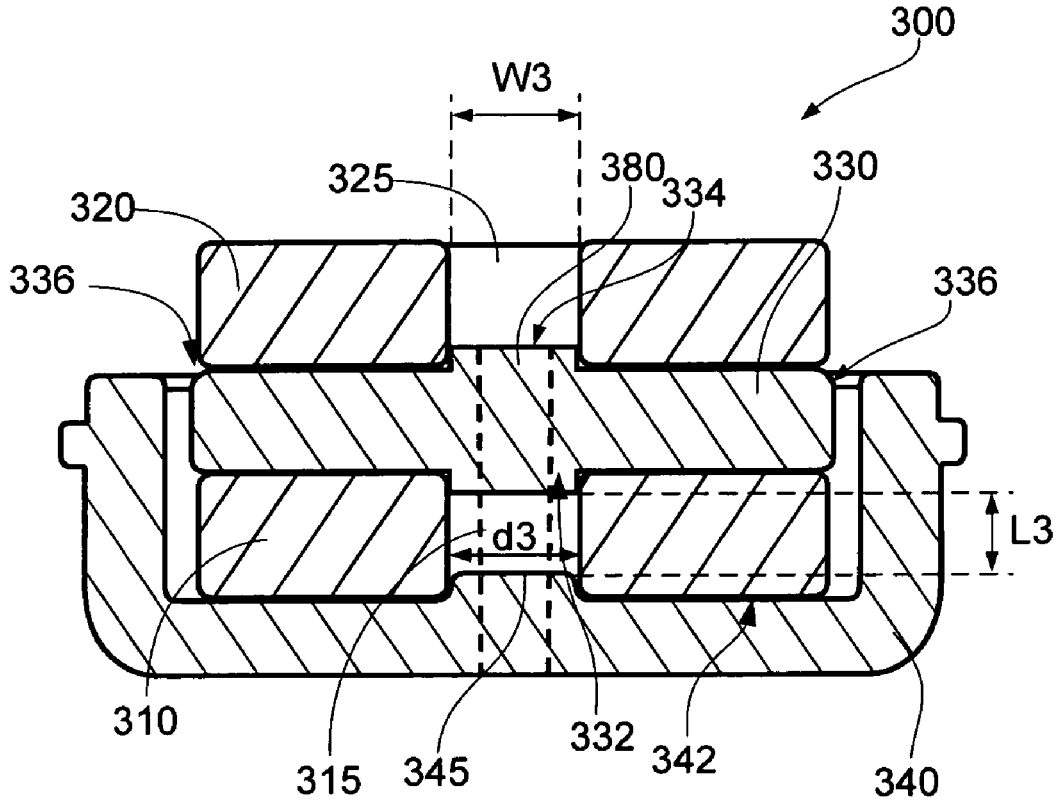
FIG. 3 illustrates a cross-sectional view of a first example of an interlocking magnet structure for a double magnet type.

FIG. 3 illustrates a first example of an interlocking magnet structure 300 for a double-magnet type. The interlocking magnet structure 300 includes a first magnet 310 and a second magnet 320. A core cap 330 is disposed between the first magnet 310 and the second magnet 320. The core cap 330 may be solid and one-piece. A shell pot 340 may contain the first magnet 310 in its hollow interior 336. The second magnet 320 may be disposed in a space above the shell pot 340.

The core cap 330 has a first nub 332 and a second nub 334 that are protrusions that vertically extend in a direction along the central axis of the motor 300. The first magnet 310 includes a first aperture 315 and the second magnet 320 includes a second aperture 325. The first magnet 310 interlocks with the first nub 332 and the second magnet 320 interlocks with the second nub 334. The shell pot 340 has a protrusion 345 perpendicularly extending from a base surface 342 thereof. The first magnet 310 may engage with the first nub 332 of the core cap 330 and the protrusion 345 of the shell pot 340, as described above in conjunction with FIG. 1.

The second magnet 320 further interlocks with the second nub 334 of the core cap 330. The second nub 334 engages with the aperture 325 of the second magnet 320. The second magnet 320 may be mounted on the core cap 330 above the shell pot 340. The second magnet 320 may have a diameter d3 and the second nub 334 may have a width w3. The diameter d3 may be substantially identical to or slightly greater than the width w3, so that the second nub 334 may be press fit into the aperture 325.

Like the magnet structure 100 of FIG. 1, a determined length L3 should be maintained between the first nub 332 and the protrusion 345, to prevent a magnetic short circuit. Dimensions for the width w3, the length L3 and the diameter d3 may vary depending on the size of the magnets 310 and 320, the type of material of the magnets 310 and 320, the strength of the magnetic flux from the magnets 310 and 320, the thickness of the core cap 330, etc. By way of example only, the width w3, the length L3 and the diameter d3 may have the following relation:

$$d3 \geqq w3 > L3 \qquad \text{(Equation 1)}$$

The first aperture 315 may have greater or smaller diameter than that of the second aperture 325. The widths of the first nub 332 and the second nub 334 may vary accordingly. In the motor 300, the magnets 310 and 320 may have identical size, shape and apertures, but various other constructions of the magnets 310 and 320 and the apertures 315 and 325 are possible. The apertures 315 and 325 may have a cylindrical shape, but they may be tapered, or they may be rectangular shaped. The shape and size of the nubs 332 and 334 and the protrusion 345 may be changed accordingly.

Figure 4:
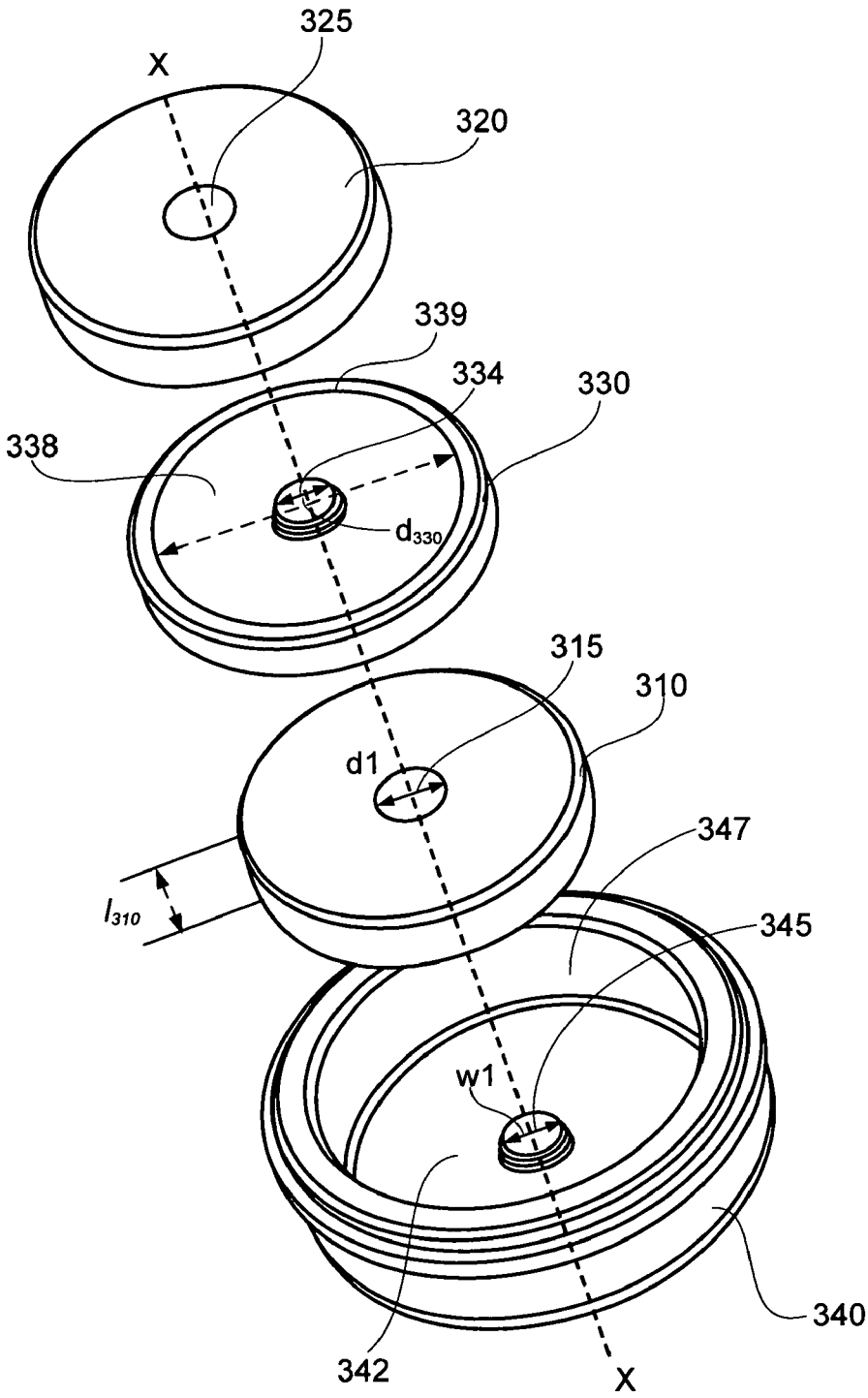
FIG. 4 is an exploded view of the interlocking magnet structure of FIG. 3.
Figure 5:
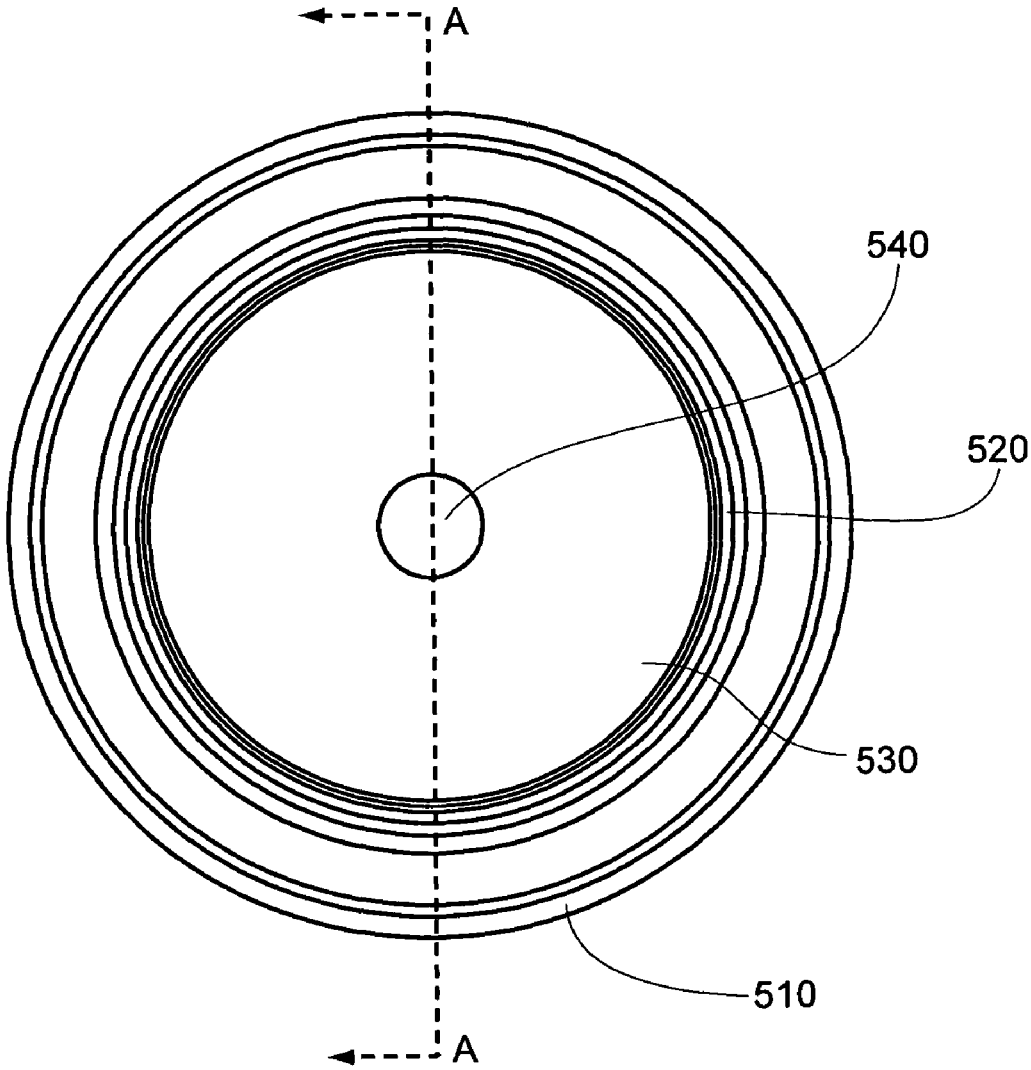
FIG. 5 is a top view of the interlocking magnet structure of FIG. 3.

FIG. 4 is an exploded view of the magnet structure 300 and FIG. 5 is a top view of the magnet structure 300. In FIG. 4, the shell pot 340, the first magnet 310, the core cap 330 and the second magnet 320 are illustrated along an X-X axis. In FIG. 4, the first magnet 310 is mounted on the shell pot 340 to be at least partially surrounded by an interior wall 347 of the shell pot. The first magnet 310 has the first aperture 315 and the shell pot 340 includes the protrusion 345. The first magnet 310 is secured to the shell pot 340 with the interlock between the first magnet 310 and the vertical protrusion 345. Because the first aperture 315 and the vertical protrusion 345 are disposed at the center of the first magnet 310 and the shell pot 340, the first magnet 310 is centrally positioned.

The second nub 334 of the core cap 330 is shown in FIG. 4. The core cap 330 may be mounted on the first magnet 310. The first nub 332, although not shown in FIG. 4, may be inserted into the first aperture 315 of the first magnet 310. The length $l_{310}$ of the first magnet 310 may be determined to provide the sufficient value for the length L3 (FIG. 3) after the first nub 332 and the protrusion 345 are inserted into the first aperture 315. In other examples, the first and second nubs 332 and 334, the protrusion 345 and the corresponding aperture 315, may be tapered, include a roughened surface, or may include any other geometry and/or feature(s) that provides an interlocking. At the top of the magnet structure 300, the second magnet 320 is mounted on a surface 338 of the core cap 330 having a surface area encompassed within an outer edge 339. The second magnet 320 may engage with the second nub 334 when the second nub 334 is inserted in the aperture 325. The motor assembly is completed. No adhesive may be needed during this assembly as long as the interlock among the first and second magnets 310 and 320, the nubs 332 and 334 and the protrusion 345 are suitably sized. Alternatively, adhesives may be used to strengthen the assembly and/or enhance the interlock.

In FIG. 5, the assembled magnet structure 300 is illustrated in a top view. FIG. 3 corresponds to a cross-sectional view along line A-A of FIG. 5. The outermost circle 510 corresponds to the shell pot 340 and the middle circle 520 corresponds to the core cap 330. The first magnet 310 is not shown in FIG. 5 because it is hidden beneath the core cap 330 and the second magnet 320. The second magnet 320 corresponds to the innermost circle 530. At the center 540, the second nub 334 is shown because it enters the second aperture 325 and engages with the second magnet 320.

Figure 6:
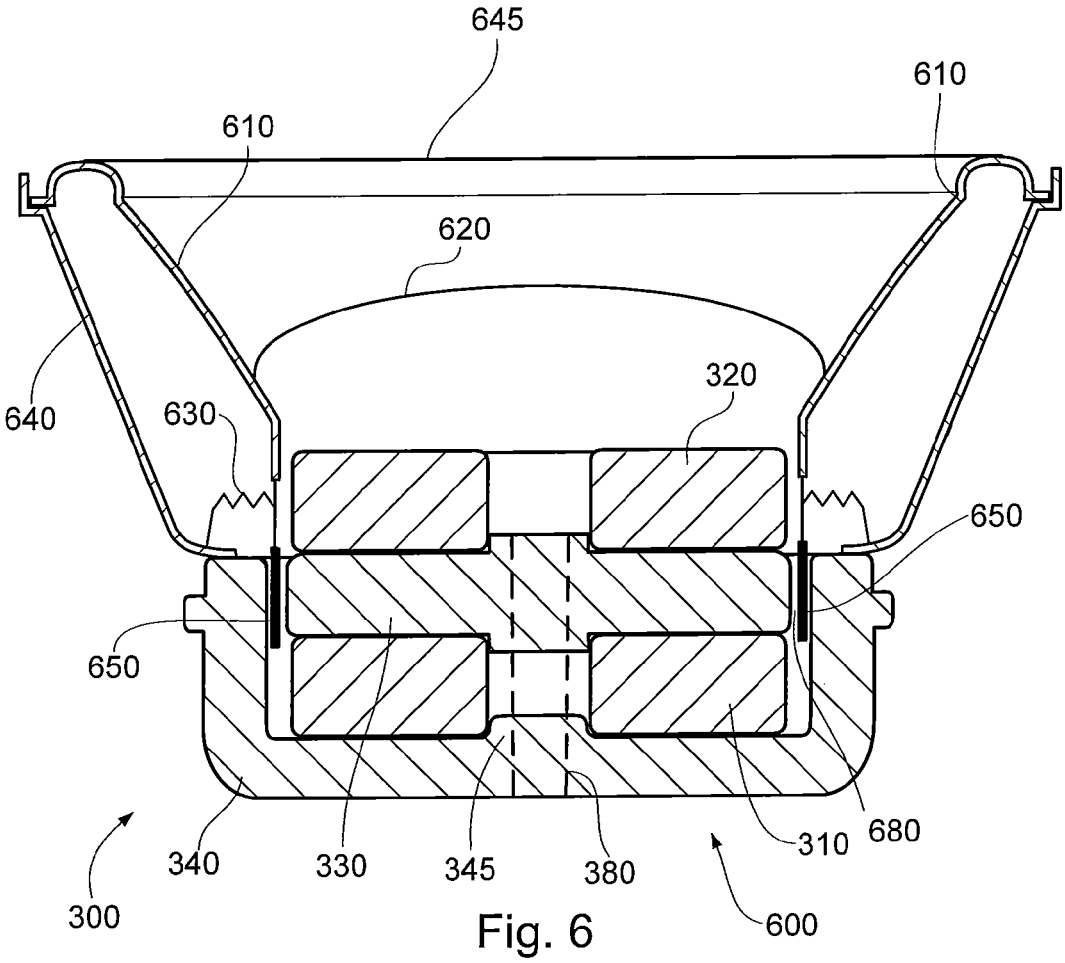
FIG. 6 illustrates a cross-sectional view of an example loudspeaker having the double-magnet interlocking magnet structure of FIG. 3.

FIG. 6 illustrates an example loudspeaker 600 having the interlocking magnet structure 300. One end of a first diaphragm 610 is attached to a voice coil 650. A second diaphragm 620 is attached to the first diaphragm 610. For example, the second diaphragm 610 may be glued to the first diaphragm 610. The second diaphragm 620 may operate as a dust cap that keeps the loudspeaker 600 from dirt, dust, etc. The first diaphragm 610 may be secured to the voice coil 650, and the voice coil 650 may be secured with a spider 630 to a frame 640 of the loudspeaker 600. The other end of the first diaphragm 610 may be coupled with a surround 645. The surround 645 may be coupled with an outer edge of the frame 640. The magnet structure 300 may interact with the voice coil 650 in the air gap 680 where the voice coil 650 is positioned. Operations of the loudspeaker 600 are not described here in detail. In the loudspeaker 600, the first and second magnets 310 and 320 may have substantially identical in size and shape. In other examples, the first magnet 310 and the second magnet 320 may differ in size. Additionally, the first magnet 310 may have different shape from that of the second magnet 320. Structures such as diaphragms, voice coils, etc. may be exemplary only and the loudspeaker 600 may not be limited thereto.

As described above, the magnet structure 300 has the solid core cap 330. Alternatively, a passageway 380 as shown in dotted lines in FIGS. 3 and 6 may be formed in the core cap 330 for venting. The passageway 380 may also penetrate the protrusion 345 and extend through the shell pot 340. While the voice coil 650 and the magnet structure 300 may be interacting with each other, heat may generate. In particular, the voice coil 650 may carry high current and substantial amount of heat may need to be dissipated. The heat may undermine the operation of the loudspeaker 600 especially when the magnets 310 and 320 may have lower thermal conductivity such as ceramic magnets. Air movement through the passageway 380 formed in the core cap 330 and the shell pot 340 may help to dissipate the heat.

Figure 7:
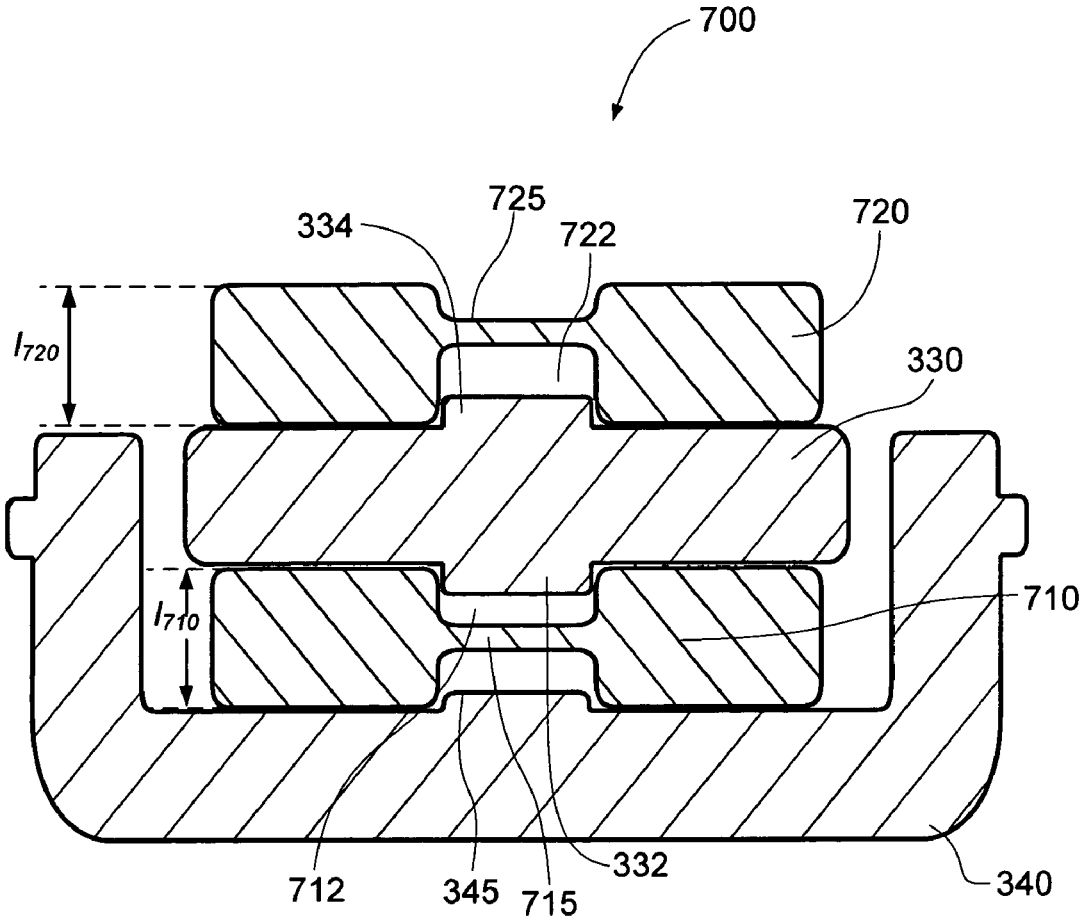
FIG. 7 illustrates a cross-sectional view of a second example of a double-magnet interlocking magnet structure having connection members.

FIG. 7 illustrates a second example of a double magnet type interlocking magnet structure 700. The magnet structure 700 includes a first magnet 710 and a second magnet 720. The core cap 330 and the shell pot 340 as described with reference to FIG. 3 may be included in the magnet structure 700. The magnets 710 and 720 may have no apertures and include first and second connection members 715 and 725, respectively. The connection members 715 and 725 may be smaller in depth than lengths 1710 and 1720 of magnets 710 and 720 such that the first and second nubs 332 and 334 can interlock with the magnets 710 and 720. The first magnet 710 may have a trench 712 that receives in part the first nub 332 of the core cap 330 without contact of the first nub 332 with the first connection member 715. The connection member 715 may be disposed to allow the protrusion 345 of the shell pot 340 to interlock with the first magnet 710 without contact of the protrusion 345 with the first connection member 715. For instance, the first connection member 715 may be positioned at a middle distance between the first nub 332 and the protrusion 345. The second connection member 725 of the second magnet 720 also may form a trench 722 to provide for insertion of the second nub 334. The location of the second connection member 725 may not be limited as long as there is sufficient space for the second nub 334. Various other shapes and sizes of magnets other than the magnets 710 and 720 are possible. The first and second magnets 710 and 720 may differ in size and shape in other examples.

Figure 8:
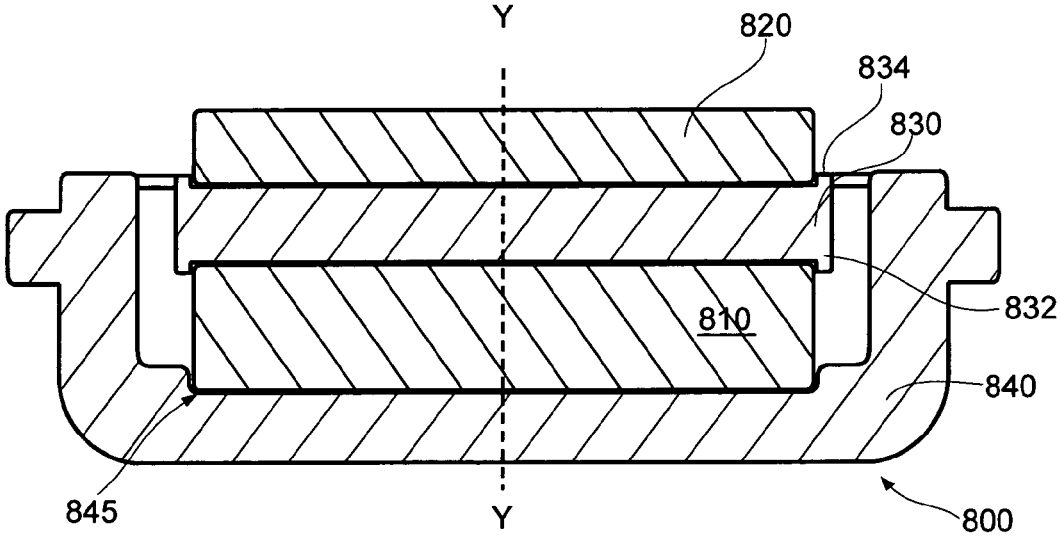
FIG. 8 illustrates a cross-sectional view of a third example of a double-magnet interlocking magnet structure having double flanges.

FIG. 8 illustrates a third example of an interlocking magnet structure 800 for a double magnet type. The magnet structure 800 includes a first magnet 810, a second magnet 820, a core cap 830 and a shell pot 840. The magnets 810 and 820 may be any type of a magnet for use with a magnet structure. Preferably, the magnets 810 and/or 820 may be made from neodymium. The second magnet 820 may be smaller or greater in size than the first magnet 810. Unlike magnets of the first and second examples of the motors 300 and 600, the magnets 810 and 820 do not have any aperture, trench or opening. The magnets 810 and 820 may be solid. In FIG. 8, the magnets 810 and 820 may have a disc shape. Accordingly, the shell pot 840 and the core cap 830 may have corresponding disc shape. In other examples, the magnets 810 and 820 can be any other shape.

The core cap 830 may include a first flange 832 and a second flange 834. The flanges 832 and 834 may be radially formed at a circumferential edge of the core cap 830. The first flange 832 may extend toward the shell pot 840 and the second flange 834 may extend in an opposite direction to the first flange 832. The core cap 830 may be placed between the first magnet 810 and the second magnet 820 so that the first flange 832 may radially extend along an outer edge of the first magnet 810. Likewise, the second flange 834 may radially extend along an outer edge of the second magnet 820. The length of the flanges 832 and 834 may vary depending on the size of the magnets 810 and 820, the strength of the magnetic flux, etc. The length of the flanges 832 and 834 may not be limited to a certain dimension as long as the core cap 830 interlocks with the magnets 810 and 820. The interlock between the first flange 832 and the first magnet 810 may refer to the description of the flange 225 and the magnet 210 described with reference to FIG. 2. Adhesives may be used to secure the magnets 810 and 820 on opposed surfaces of the core cap 830. The first and second flanges 832 and 834 may prevent the magnets 810 and 820 from shifting relative to a central axis Y-Y.

The shell pot 840 may include a recess 845 at its center. The recess 845 may receive the first magnet 810 so that the magnet 810 may be positioned at the center. Alternatively, the off-center arrangement of the magnet 810 is possible. The first magnet 810 may be secured in the center position with recess 845 and adhesives may or may not be used, as described above in FIG. 2. The flanges 832 and 834 and the recess 845 may secure the central positioning of the magnets 810 and 820. With or without adhesives, the flanges 832 and 834 and the recess 845 may prevent the magnets 810 and 820 from being displaced from the central axis Y-Y of the magnet structure 800.

The shell pot 840 may be formed to have the recess 845 at its center. The recess 845 may be deeper or shallower depending on the size of the magnet 810. For a large magnet 810, the deeper recess 845 may provide firm positioning. The first magnet 810 may be rigidly mounted at least partially in the recess 845. Adhesive may be used to strengthen the mounting of the first magnet 810. The core cap 830 may be produced to have the first and second flanges 832 and 834. The heights of the flanges 832 and 834 may be determined in view of the length and size of the magnets 810 and 820. If the two magnets 810 and 820 may differ in size and length, then the first and second flanges 832 and 834 may differ in their heights. The core cap 830 may be mounted on the first magnet 810. Adhesive may or may not be added and to strengthen the connection between the core cap 830 and the second magnet 820. The second magnet 820 may be mounted on the core cap within a space at least defined by the second flange 834. Adhesive may or may not be used upon need. Manufacturing of the motor 800 may be relatively simple and easy. The positioning of the magnets 810 and 820 may be preserved with the flanges 832 and 834 and the recess 845, regardless of adhesive state in the motor 800.

Figure 9:
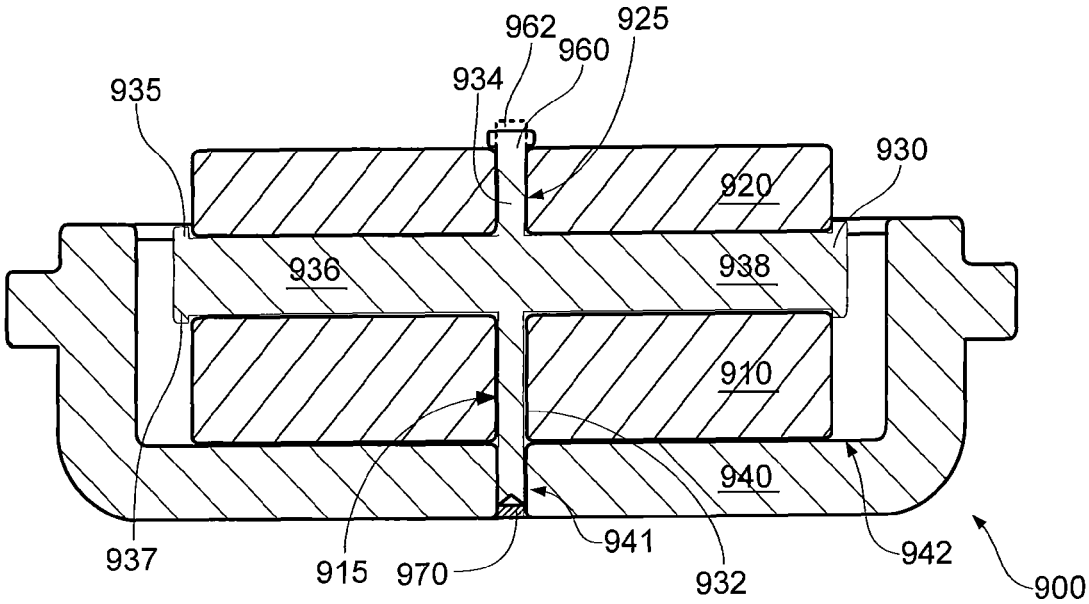
FIG. 9 illustrates a cross-sectional view of a fourth example of a double-magnet interlocking magnet structure.

FIG. 9 illustrates a fourth example of an interlocking magnet structure 900 for a double magnet type. The magnet structure 900 includes a first magnet 910, a second magnet 920, a core cap 930 and a shell pot 940. The magnets 910 and 920 may have apertures 915 and 925 at their center, respectively. The magnets 910 and 920 may have a disc shape or any other shape. The core cap 930 may have a cross shape in its cross sectional view that extends horizontally and vertically relative to the magnets 910 and 920, as shown in FIG. 9. The core cap 930 may have two members intersecting with each other perpendicularly. To that end, the core cap 930 includes a first extension member 932, and a second extension member 934 forming one of the members, and a third extension member 936 and a fourth extension member 938 forming the other of the members. Flanges 935 and 937 may be provided at a peripheral edge of the core cap 930 to further secure the magnets 910 and 920. Alternatively, flanges 935 and 937 may be omitted. The shell pot 940 may be formed to include an opening 941 at the center of an interior surface 942 of the shell pot 940.

The first extension member 932 extends through the aperture 915 of the first magnet 910 and may be press fit into the aperture 935 of the shell pot 940. A dimple 970 may be used as a centering member during the assembly process. Alternatively, the dimple 970 may not be used. The third and fourth extension members 936 and 938 may apply a compression force to the first magnet 910 downwardly. As a result, the first magnet 910 may remain centrally positioned. The second extension member 934 may extend through the aperture 925. At a top surface of the second magnet 920, the second extension member 934 may be secured by creating a restraining head 960. The restraining head 960 has a pre-form 962 as indicated in a dotted line in FIG. 9. The restraining head 960 may be formed with a rivet gun, or various other tools that apply pressure on the pre-form 962. As a result of application of pressure, the restraining head 960 may be flattened out and expanded horizontally. The restraining head 960 may secure the second magnet 920 in place.

In FIG. 9, the vertical extensions such as the first extension 932 and the second extension 934 may have a diameter smaller than that of the horizontal extensions such as the third and fourth extensions 936 and 938. For instance, the diameter of the vertical extensions may be about a quarter of the thickness of the horizontal extensions. The smaller diameter of the vertical extensions may increase resistance in a path through which the magnetic flux from the magnets 910 and 920 travel. As a result, the magnet structure 900 may not experience a significant magnetic short circuit.

The magnet structure 900 may or may not require use of adhesives. The core cap 930, the magnets 910 and 920, and the shell pot 940 may interlock and firmly secure the position of the magnets 910 and 920. The magnet structure 900 is used as a double magnet type in FIG. 9, but it is not limited thereto. The interlocking mechanism of the core cap 930 and the first magnet 910 may be used with a single magnet type motor. In the single magnet type motor, the second magnet 920 is not used; the second extension member 934 may be omitted. The rest of the structures used in the magnet structure magnet structure 900 may remain for use with the single magnet type.

Figure 10:
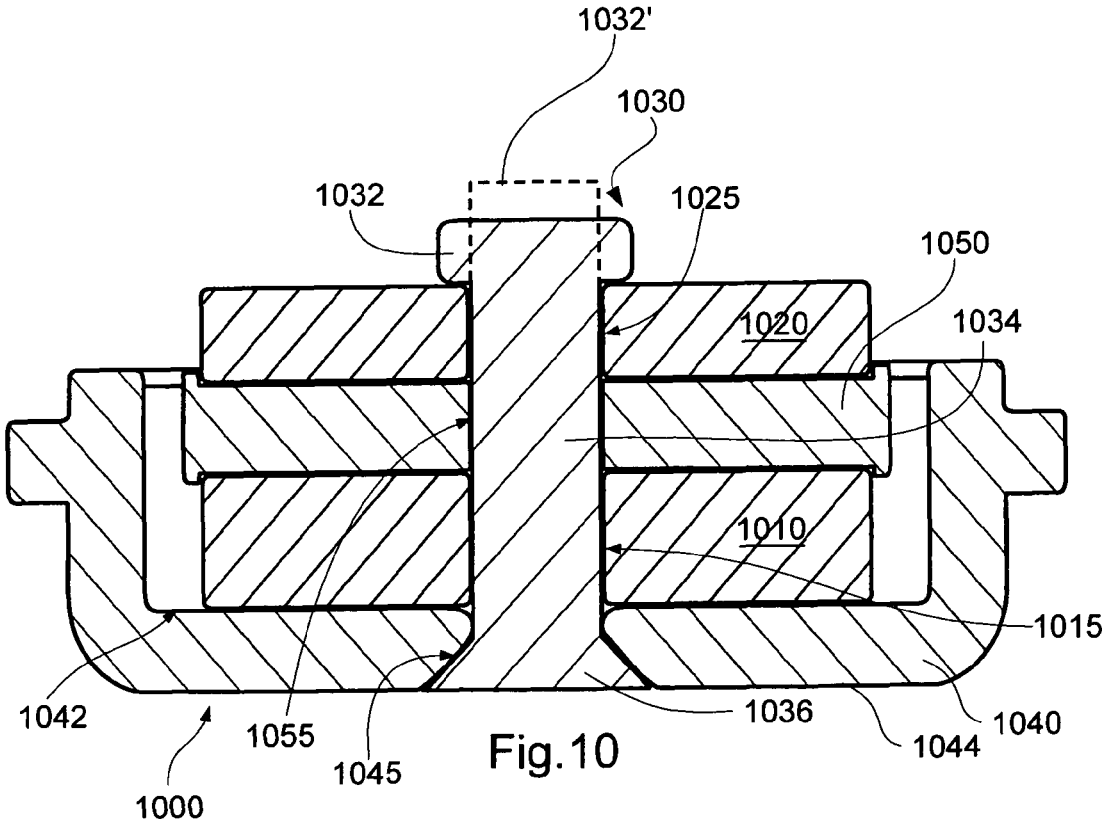
FIG. 10 illustrates a cross-sectional view of a fifth example of a double-magnet interlocking magnet structure having a fastener.

FIG. 10 illustrates a fifth example of an interlocking magnet structure 1000 for a double magnet type. The magnet structure 1000 includes a first magnet 1010, a second magnet 1020, a core cap 1050, a shell pot 1040 and a fastener 1030. The magnets 1010 and 1020 may have first and second respective apertures 1015 and 1025 at their center. Alternatively, only one magnet 1010 may be provided and the motor 1000 may be a single magnet type. The core cap 1050 is formed with an aperture 1055. The core cap 1050 is disposed between the magnets 1010 and 1020. The shell pot 1040 may have an opening 1045 that starts from a base surface 1042 to a bottom surface 1044. The first and second apertures 1015 and 1025, the apertures 1055 and the opening 1045 may be formed to accommodate the fastener 1030.

The fastener 1030 may be made from nonmagnetic material. For instance, the fastener 1030 may be made from brass, aluminum, or plastic. The fastener 1030 may be a rivet that includes a head member 1036, and a body member 1034. Accordingly, upon engagement with the second magnet 1020, a portion of the body member 1034 is disposed above the top surface of the second magnet 1020 as illustrated in FIG. 10. The body member 1034 may have a cylindrical shape. The body member 1034 may penetrate through the apertures 1025, 1055 and 1015. The shape of the fastener 1030 in FIG. 10 may be by way of example only and various other fasteners capable of interlocking at least one magnet with a shell pot and a core cap are possible.

As the fastener 1030 may extend through the apertures 1015, 1025 and 1055 and the opening 1045, it engages with the magnets 1010 and 1020, the core cap 1050 and the shell pot 1040. The magnets 1010 and 1020 may be centrally secured to the shell pot 1040 with the fastener 1030. The core cap 1050 also may be secured between the two magnets 1010 and 1020 with the fastener 1030. The shop-head member 1032 of the fastener 1030 also may apply pressure onto the top surface of the second magnet 1020, thereby further securing the second magnet 1020. Due to being interlocked with the fastener 1030, the magnets 1010 and 1020 may not be shifted from a central axis of the motor 1000.

The fastener 1030 may be inserted into the aligned apertures 1015, 1025 and 1055. The head member 1036 and the body member 1034 of the fastener 1030 may be inserted into the aligned apertures 1015, 1025 and 1055. The shop-head member 1032 may not be formed until other parts of the fastener 1030 fully engage with the magnets 1010 and 1020 and the core cap 1050. A pre-form 1032' of the head member 1032 is indicated as dotted line in FIG. 10. After full engagement, the shop-head member 1032 may be formed with a rivet gun. Alternatively, the head member 1032 may be formed with a tool that applies a certain amount of pressure on the pre-form 1032' at the top of the fastener 1030. The pre-form 1032' may protrude above the top surface of the second magnet 1020. Due to the pressure applied thereon, the protruded portion of the fastener 1030 may be flattened out and expanded horizontally. As a result, the head member 1032 may capture the second magnet 1020 in place.

Alternatively, when the apertures 1015, 1025 and 1055 may be aligned, nonmagnetic material forming the fastener 1030 such as plastic may be injected. To that end, the magnets 1010 and 1020, the core cap 1050 and the shell pot 1040 may be placed in an injection molding machine. The injected material may be molded into the fastener 1030 in the aligned apertures 1015, 1025 and 1055. In that case, the head/body members 1036, 1034 and 1032 may be formed together and engage with members of the magnet structure 1000. The members of the magnet structure 1000 such as the magnets 1010 and 1020, the core cap 1050 and the shell pot 1040 may operate as a fastener mold such that the fastener 1030 having the shape shown in FIG. 10 may be formed. Additionally, a venting passageway, although not shown in FIG. 10, may be provided through the fastener.

The magnet structure 1000 may secure positioning of the magnets 1010 and 1020, the core cap 1050 and the shell pot 1040 with the fastener 1030. The fastener 1030 may be made from nonmagnetic material and may not cause a magnetic short circuit by providing resistance on a magnetic flux traveling path. The fastener 1030 may firmly secure the positioning of the magnet structure 1000, regardless of the magnet structure 1000's working environment. The magnet structure 1000 may or may not use adhesive for interlocking the motor members and is able to secure the firm positioning.

The interlocking magnet structures 100, 200, 300, 700, 800, 900 and 1000 described above may secure the position of the magnets in the shell pot with interlocking of the magnets, the core cap and/or the shell pot. The interlocking mechanism may involve, for example, mechanical overlapping, insertion, mounting, engagement, etc. The interlocking mechanism may not require additional and/or external members or structure to form the interlock. Rather, the magnet, the core cap and the shell pot may internally form the interlock structure. In particular, to perform the interlocking, structures such as the flange, the aperture, the projection, the protrusion, the nub, the recess, etc. may be used. The interlocking structures may be stable and resistant to working environment of the magnet structure such as mobile, outdoor environment. For instance, a loudspeaker used in vehicles may have a longer life span with the interlocking magnet structure 100, 200, 300, 700, 800, 900 and 1000. Whether adhesive may be used or not, the interlocking structure may not be substantially affected by the working environment and/or conditions of adhesive. The position of the magnets may be secured at the center of the motor and may not shift, despite a prolonged use of the magnet structure 100, 200, 300, 700, 800, 900 and 1000, working environment of the magnet structure, etc. As a result, the loudspeakers employing the magnet structures 100, 200, 300, 700, 800, 900 and 1000 may operate properly and have a long lifespan. Further, manufacturing of the interlocking magnet structure may be simple and easy and may not require sophisticated processes and/or increased expenses.

The interlocking magnet structure 100, 200, 300, 700, 800, 900 and 1000 may be used with a single magnet type and a double magnet type. The magnet(s) may have apertures or no apertures and may be solid, depending on various interlocking mechanisms. Size, dimensions, shapes and type of magnets, core caps, and shell pots may vary depending on the interlocking mechanisms. For venting purposes, the passageway may be provided to the motors 100, 200, 300, 700, 800, 900 and 1000.

In the illustrated interlocking magnet structure 100, 200, 300, 700, 800, 900 and 1000, concentric arrangements are described. Alternatively, the magnet structures may interlock at off-center position(s). Additionally, in the illustrated magnet structure, two or more nubs, protrusions, apertures, etc. are possible and the interlocking members may not be limited to a single nub, protrusion, aperture, etc.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A loudspeaker having a magnet structure, comprising:
a magnet having a first surface and a second surface;
a core cap mounted on the first surface of the magnet;
a shell pot configured to receive the magnet and the core cap in a hollow interior, where the second surface of the magnet contacts a base surface of the shell pot;
where the magnet, the core cap and the shell pot are configured to interlock to fixedly position the magnet with respect to the core cap and the shell pot, the core cap comprising a first protrusion, and the shell pot comprising a second protrusion, the magnet formed with an aperture to accommodate and provide engagement of the first protrusion and the second protrusion with the magnet; and
a vent passageway formed to penetrate the core cap and the shell pot and extend through the aperture of the magnet.

2. The magnet structure of claim 1, where the first protrusion is spaced apart from the second protrusion in the aperture to avoid a magnetic short circuit.

3. The motor of magnet structure 1, where the aperture is a center aperture that comprises a diameter (d) and the first protrusion comprises a first width ($w_1$) and the second protrusion comprises a second width ($w_2$), the first width ($w_1$) and the second width ($w_2$) being substantially identical to, or smaller than the diameter (d).

4. The magnet structure of claim 3, where the first protrusion is spaced apart from the second protrusion by a determined gap (g).

5. A loudspeaker having a magnet structure, comprising:
a magnet having a first surface and a second surface;
a core cap mounted on the first surface of the magnet; and
a shell pot configured to receive the magnet and the core cap in a hollow interior, where the second surface of the magnet contacts a base surface of the shell pot; and
where the magnet, the core cap and the shell pot are configured to interlock to fixedly position the magnet with respect to the core cap and the shell pot, and the core cap comprises a flange that surrounds a peripheral edge of the magnet and extends toward the shell pot.

6. A loudspeaker having a magnet structure, comprising:
a magnet having a first surface and a second surface;
a core cap mounted on the first surface of the magnet; and
a shell pot configured to receive the magnet and the core cap in a hollow interior, where the second surface of the magnet contacts a base surface of the shell pot; and
where the magnet, the core cap and the shell pot are configured to interlock to fixedly position the magnet with respect to the core cap and the shell pot, the core cap comprising a first protrusion and the shell pot comprising a second protrusion, and at least a part of the magnet interlocks with the first protrusion and the second protrusion, and where the shell pot comprises a recess on the base surface of the shell pot, the recess configured to receive the second surface of the magnet.

7. A loudspeaker having a magnet structure, comprising:
a magnet having a first surface and a second surface;

a core cap mounted on the first surface of the magnet; and a shell pot configured to receive the magnet and the core cap in a hollow interior, where the second surface of the magnet contacts a base surface of the shell where the magnet, the core cap and the shell pot are configured to interlock to fixedly position the magnet with respect to the core cap and the shell pot, the core cap comprising a first protrusion and the shell pot comprising a second protrusion, and at least a part of the magnet interlocks with the first protrusion and the second protrusion; and a fastener configured to engage with the magnet, the core cap and the shell pot through aligned apertures formed in each of the magnet the core cap and the shell pot.

8. A loudspeaker having a magnet structure, comprising:

a first magnet;

a second magnet positioned in parallel with the first magnet;

a core cap disposed between the first magnet and the second magnet; and a shell pot containing at least the first magnet and the core cap;

where at least a part of the first magnet interlocks with the shell pot and the core cap, and at least a part of the second magnet interlocks with the core cap, the core cap comprising a first nub and a second nub, the first nub extending in an opposite direction to the second nub.

9. The magnet structure of claim 8, where the first magnet comprises a first aperture and the first nub is insertable in the first aperture to engage with the first magnet.

10. The magnet structure of claim 9, where the second magnet comprises a second aperture and the second nub is insertable in the second aperture to engage with the second magnet.

11. The magnet structure of claim 9, where the shell pot comprises a protrusion, and the first aperture is configured to accommodate the protrusion so that the protrusion is engaged with the first magnet.

12. The magnet structure of claim 8, where the shell pot comprises a recess that is formed to receive the first magnet.

13. A loudspeaker having a magnet structure, comprising:

a first magnet;

a second magnet positioned in parallel with the first magnet;

a core cap disposed between the first magnet and the second magnet; and a shell pot containing at least the first magnet and the core cap;

where at least a part of the first magnet interlocks with the shell pot and the core cap, and at least a part of the second magnet interlocks with the core cap, the core cap comprising a flange at an edge of the core cap that is formed to surround a peripheral edge of at least one of the first magnet or the second magnet.

14. A loudspeaker having a magnet structure, comprising:

a first magnet;

a second magnet positioned in parallel with the first magnet;

a core cap disposed between the first magnet and the second magnet; and a shell pot containing at least the first magnet and the core cap;

where at least a part of the first magnet interlocks with the shell pot and the core cap, and at least a part of the second magnet interlocks with the core cap, the core cap comprising a first flange and a second flange, the first flange surrounding a peripheral edge of the first magnet and extending toward the shell pot and the second flange surrounding a peripheral edge of the second magnet and extending opposite to the first flange.

15. A loudspeaker having a magnet structure, comprising:

a first magnet;

a second magnet positioned in parallel with the first magnet;

a core cap disposed between the first magnet and the second magnet; and a shell pot containing at least the first magnet and the core cap;

where at least a part of the first magnet interlocks with the shell pot and the core cap, and at least a part of the second magnet interlocks with the core cap;

the core cap comprising a first extension member and a second extension member, the first extension member extending through a first center aperture of the first magnet, and the second extension member extending through a second center aperture of the second magnet.

16. The magnet structure of claim 15, where the core cap comprises a third extension member and a fourth extension member and where the third and fourth extension members extend perpendicular to the first and second extension members.

17. The magnet structure of claim 16, where the first and second extension members are configured to be smaller in diameters than the third and fourth extension members.

18. The magnet structure of claim 16, where the shell pot comprises an opening that is formed to receive the first extension member.

19. The magnet structure of claim 18, where the first extension member is securable to the shell pot with an extension member.

20. The magnet structure of claim 16, where the second extension member is securable to the second magnet with a restraining head, the restraining head formed at one end of the second extension member and expanding over the top surface of the second magnet.

21. The magnet structure of claim 16, where the core cap engages with the first and the second magnets vertically and horizontally.

22. A loudspeaker having a magnet structure, comprising:

a first magnet;

a second magnet positioned in parallel to the first magnet;

a core cap vertically disposed between the first magnet and the second magnet; and a shell pot containing at least the first magnet and the core cap;

where the first magnet, the second magnet, the core cap, and the shell pot interlock with a fastener that extends through aligned apertures included in each of the first magnet, the second magnet, the core cap and the shell pot, the fastener comprising a head member, a body member, and a shop head member, the shop head member formed against a surface of the second magnet, and the head member engaged with the shell pot.

23. The loudspeaker of claim 22, where the body member is engaged at least with the first magnet, the core cap and the second magnet.

24. The loudspeaker of claim 22, where the shop-head member is larger in a diameter than the aligned apertures and the head member has a frusto-conical shape.

25. A loudspeaker having a magnet structure, comprising:

a first magnet;

a second magnet positioned adjacent to the first magnet;

a core cap disposed between the first magnet and the second magnet;

a shell pot containing at least the first magnet; and a fastener comprising a body member having a first end and a second end, the body member engaged with the shell pot at the first end and extending through apertures formed in each of the first magnet, the second magnet and the core cap, the fastener formed to include a shop head member at the second end so that the first magnet, the second magnet and the core cap are interlocked and secured to the shell pot by the fastener.

26. The loudspeaker magnet structure of claim 25, where at least a part of the first magnet is interlocked with the core cap.

27. The loudspeaker magnet structure of claim 25, where at least a part of the second magnet is interlocked with the core cap.

28. The loudspeaker magnet structure of claim 25, where the fastener comprises a nonmagnetic material.

29. The loudspeaker magnet structure of claim 25, where the body member is cylindrical.

30. The loudspeaker magnet structure of claim 25, where the fastener is operable to be engaged with the first magnet, the second magnet, and the core cap to secure the core cap to at least one of the first magnet and the second magnet.

31. The loudspeaker magnet structure of claim 25, where the shell pot is formed to include an aperture and the first end of the fastener is disposed in the aperture of the shell pot.

32. The loudspeaker magnet structure of claim 31, where the first end of the fastener is press fit into the aperture of the shell pot.

* * * * *